US010669801B2

(12) United States Patent
Roberts-Haritonov

(10) Patent No.: US 10,669,801 B2
(45) **Date of Patent: *Jun. 2, 2020**

(54) SUBSEA TREE OVERRIDE TOOL APPARATUS AND METHOD

(71) Applicant: NEPTUNE SUBSEA ENGINEERING LTD, Aberdeen (GB)

(72) Inventor: Lev Uryevich Roberts-Haritonov, Aberdeen (GB)

(73) Assignee: NEPTUNE SUBSEA ENGINEERING LTD, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/759,057

(22) PCT Filed: Sep. 8, 2016

(86) PCT No.: PCT/GB2016/052783

§ 371 (c)(1),
(2) Date: Mar. 9, 2018

(87) PCT Pub. No.: WO2017/042571

PCT Pub. Date: Mar. 16, 2017

(65) Prior Publication Data

US 2019/0040706 A1 Feb. 7, 2019

(30) Foreign Application Priority Data

Sep. 10, 2015 (GB) ..... 1516031.0

(51) Int. Cl.
*E21B 33/035* (2006.01)
*E21B 41/04* (2006.01)
(Continued)

(52) U.S. Cl.
CPC ..... *E21B 33/0355* (2013.01); *B63C 11/52* (2013.01); *E21B 33/035* (2013.01); *E21B 33/0385* (2013.01); *E21B 34/04* (2013.01); *E21B 41/0007* (2013.01); *E21B 41/04* (2013.01); *E21B 41/08* (2013.01); *E21B 43/017* (2013.01); *E21B 43/0107* (2013.01)

(58) Field of Classification Search
CPC ..... E21B 33/0355; E21B 41/04; E21B 34/04
See application file for complete search history.

(56) References Cited

U.S. PATENT DOCUMENTS 6,223,675 B1 5/2001 Watt et al.
7,913,971 B2 3/2011 Hoang
(Continued)

FOREIGN PATENT DOCUMENTS

EP 0366281 A 5/1990
GB 2350659 A 12/2000
(Continued)

*Primary Examiner* — James G Sayre

(57) ABSTRACT

The present disclosure relates to subsea tool apparatus and methods, particularly but not exclusively tool apparatus and methods relating to subsea trees or so-called "Christmas trees". The subsea tool is for reinstating the functionality of a subsea tree valve actuator, by applying a thrust force to the subsea tree valve actuator stem, characterised in that: the tool gets its power supply to provide load on the actuator stem, directly or indirectly from the subsea tree SCM (subsea control module) supply.

17 Claims, 4 Drawing Sheets

(51) Int. Cl.

| | |
|---|---|
| ***E21B 43/017*** | (2006.01) |
| ***E21B 43/01*** | (2006.01) |
| ***E21B 41/08*** | (2006.01) |
| ***E21B 41/00*** | (2006.01) |
| ***E21B 33/038*** | (2006.01) |
| ***B63C 11/52*** | (2006.01) |
| ***E21B 34/04*** | (2006.01) |

(56) References Cited

U.S. PATENT DOCUMENTS

| | | | | |
|---|---|---|---|---|
| 2004/0118567 | A1 | 6/2004 | Skeels et al. | |
| 2008/0264646 | A1* | 10/2008 | Sten-Halvorsen | E21B 33/0355 166/360 |
| 2009/0212969 | A1 | 8/2009 | Voss | |
| 2012/0067593 | A1 | 3/2012 | Powell et al. | |
| 2012/0168169 | A1 | 7/2012 | Voss | |
| 2017/0101839 | A1* | 4/2017 | Roberts-Haritonov | E21B 34/04 |

FOREIGN PATENT DOCUMENTS

| | | | | |
|---|---|---|---|---|
| GB | 2458012 | A | 9/2009 | |
| GB | 2514150 | A | 11/2014 | |
| GB | 2520258 | A * | 5/2015 | B63C 11/52 |
| GB | 2520258 | A | 5/2015 | |
| WO | 2009114704 | A2 | 9/2009 | |
| WO | 2012154056 | A | 11/2012 | |
| WO | 2014155126 | A2 | 10/2014 | |

* cited by examiner

SUBSEA TREE OVERRIDE TOOL APPARATUS AND METHOD

FIELD OF THE INVENTION

The present disclosure relates to subsea tool apparatus and methods, particularly but not exclusively tool apparatus and methods relating to subsea trees or so-called "Christmas trees".

BACKGROUND TO THE INVENTION

The primary function of a subsea Christmas tree, is to control the flow of oil and gas or injection fluids to and from a subsea well. Subsea trees incorporate a number of valves in their construction for various functions.

A typical conventional or horizontal Christmas tree will include a production/injection master valve (PMV/IMV) and wing valves on both the production/injection wing of the tree (PWV/IWV) as well as the annulus wing of the tree (AWV).

The AWV is more common on wells which require the supply of gas to well 'A' annulus. On a subsea production tree, they are used to control the flow of oil/gas from the well. Equally, they are used for controlling the flow of injection fluid, if the subsea tree is an injection tree. All these valves are typically gate valves.

The subsea tree valves are actuated from closed to open position and back, using hydraulic linear actuators which are attached directly to the valves. The control of these actuators and supply of hydraulic fluid to them is done via a subsea control module (SCM), located on the tree. The SCM in turn is controlled by commands from the host installation.

Extensive subsea operation can result in leakage of hydraulic fluid from the valve actuators, causing their failure and inability to stroke the subsea tree valves. In such cases, an extensive completion work over or subsea intervention is required, to be able to recover the tree to the surface for actuator replacement. This type of operation requires a rig or vessel with the correct hardware and safety case. The consequential period of rectification will result in the well shut in and a loss of production revenue.

An established solution to a leaking/non-functioning actuator is to provide a surface override tool which would typically be installed by a diver, if water depths permit. The thrust power would be provided via a subsea hand pump. The major disadvantage is that the diver has to remain on location to provide hydraulic fluid power to the override tool.

The alternative is to leave the tool locked on to the actuator leaving, the valve permanently open. A valve locked open without the ability to close for Well Control purposes will require a deviation from the Operator's Standard Operating Policies and require dispensation from periodic Well Control Integrity testing. In most cases the regional Government acting body will be notified. For the UK sector this is the Department of Energy & Climate Change (DECC). In vast majority of cases it is impracticable to maintain this level of support.

SUMMARY OF THE INVENTION

According to a first aspect of the present invention there is provided a subsea tool for reinstating the functionality of a subsea tree valve actuator, by applying a thrust force to the subsea tree valve actuator stem, characterised in that: the tool gets its power supply to provide load on the actuator stem, directly or indirectly from the subsea tree SCM (subsea control module) supply.

The subsea tool may be adapted to be deployed by a remotely operated vehicle ("ROV").

The subsea tool may be provided with a tool docking unit socket to enable ROV-deployment.

The subsea tool may be installed and left connected to the actuator for any length of time, up to the maximum design life of the tool.

The subsea tool may be powered by fluid, mechanical spring, electricity or a combination thereof.

The tool may be connectible to the actuator body.

The tool may provide a thrust to the actuator stem.

The tool may incorporate a bladder system connected to the annulus and/or the cylinder side of the tool.

According to a second aspect of the present invention there is provided a method of modifying a subsea valve component by reinstating the functionality of a subsea tree valve actuator comprising the steps of applying a thrust force to the subsea tree valve actuator stem with a tool, and using the subsea tree SCM (subsea control module) supply to provide power to the tool.

The tool may be installed and left connected to the actuator for any length of time, up to the maximum design life of the tool.

The tool may be connected to the actuator body.

The subsea tool may be adapted to be deployed by a remotely operated vehicle ("ROV").

The subsea tool may be provided with a tool docking unit socket to enable ROV-deployment.

The tool is connected to the actuator body.

The tool may provide a thrust to the actuator stem.

The tool may incorporate a bladder system connected to the annulus and/or the cylinder side of the tool.

According to the third aspect of the present invention there is provided a subsea tree including one or more tools according to the first aspect of the present invention.

According to a fourth aspect of the present invention there is provided a subsea tree modified by the method of the second aspect of the present invention.

According to a fifth aspect of the present invention there is provided a well including one or more trees according to the third or fourth aspects of the present invention.

According to a sixth aspect of the present invention there is provided an auxiliary skid suitable for use with a subsea tool for reinstating the functionality of a subsea tree valve actuator, the auxiliary skid being attachable to a Christmas tree or similar subsea valve arrangement, the auxiliary skid having means to attach a subsea tool to it, the auxiliary skid being able to be attached to a subsea control module, and thereby allowing the subsea tool to be powered from the subsea control module.

The auxiliary skid may enable hydraulic supply pressure to be supplied from the subsea control module to the subsea tool.

The auxiliary skid may include a bridging plate.

The bridging plate may enable the hydraulic supply pressure to be routed from the subsea control module to the subsea tool via the auxiliary skid.

The auxiliary skid may include one or more bladders to compensate for hydraulic volume and/or pressure.

The auxiliary skid may include one or more accumulators to compensate for hydraulic volume and/or pressure.

The auxiliary skid may have an on board hot stab.

The auxiliary skid may have finality to control subsea tool directly from the rig/intervention vessel, in a workover scenario. This is done by a using an on board hot stab.

The method and apparatus enable effective and permanent ROV led reinstatement of subsea tree valve actuation functionality, an SCM actuated override tool, connected to the actuator body and able to provide a thrust force onto the actuator stem thus enabling full travel against the original actuator spring and well pressure.

The tool comprises of a pressure containing body; and a thrust rod which would engage with the actuator stem. A means of sealing is provided between the pressure containing body, the thrust rod and the external environment. The tool design will be ROV deployed using TDU (Tool Docking Unit). It will feature a means of locking the tool onto the actuator stem. The locking function will be performed by the ROV Torque tool, part of the TDU.

The hydraulic fluid and pressure to power the tool will be routed from the existing subsea control module (SCM) via an existing stab plate located on the Tree. All equipment necessary for effective operation of the PCOL Tool or the NEPVOS-ROV will be provided by the auxiliary skid which will be deployed with the tool. To make connection with the tree stab plate, a bridging plate is provided from the auxiliary skid. The tool is also connected hydraulically to the auxiliary skid. The auxiliary skid contains all the necessary bladders, vales and hot stabs to enable direct control.

BRIEF DESCRIPTION OF THE DRAWINGS

Embodiments of the various aspects of the invention will now be described, by way of example only, with reference to the following drawings, in which.

Figure 1:
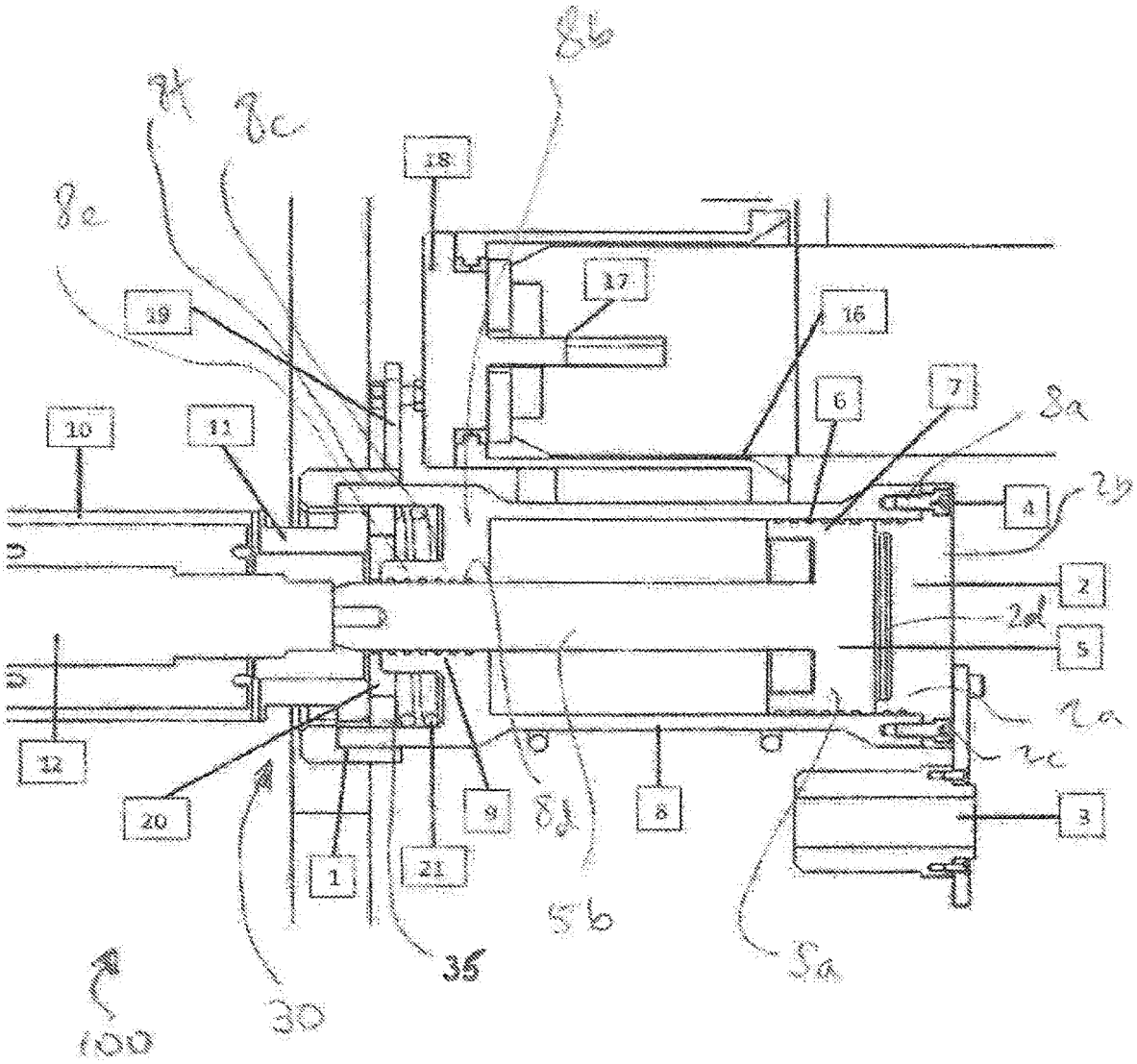
FIG. 1 is a cross-sectional elevation of a tool according to the present invention connected in situ to a subsea tree.
Figure 2:
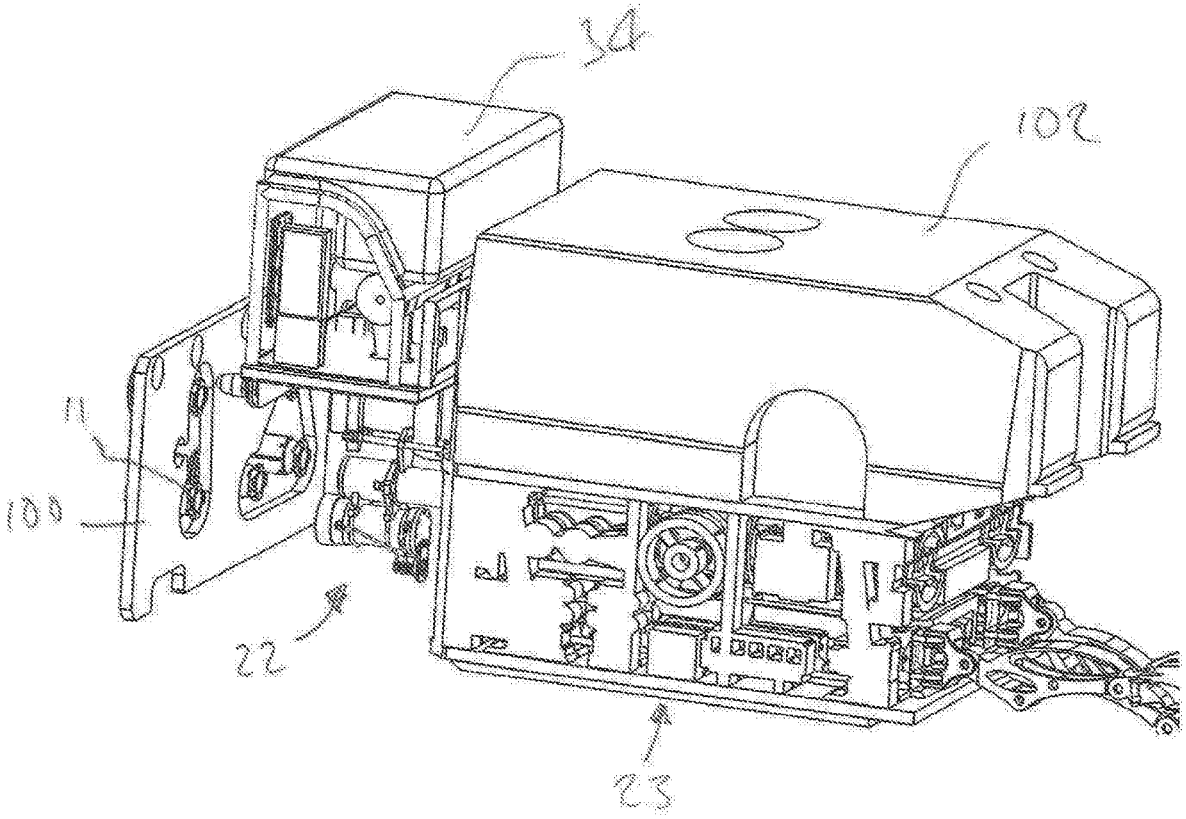
FIG. 2 is a perspective view of the tool of FIG. 1 being brought into proximity with the subsea tree of FIG. 1 with a remotely operated vehicle ("ROV")
Figure 3:
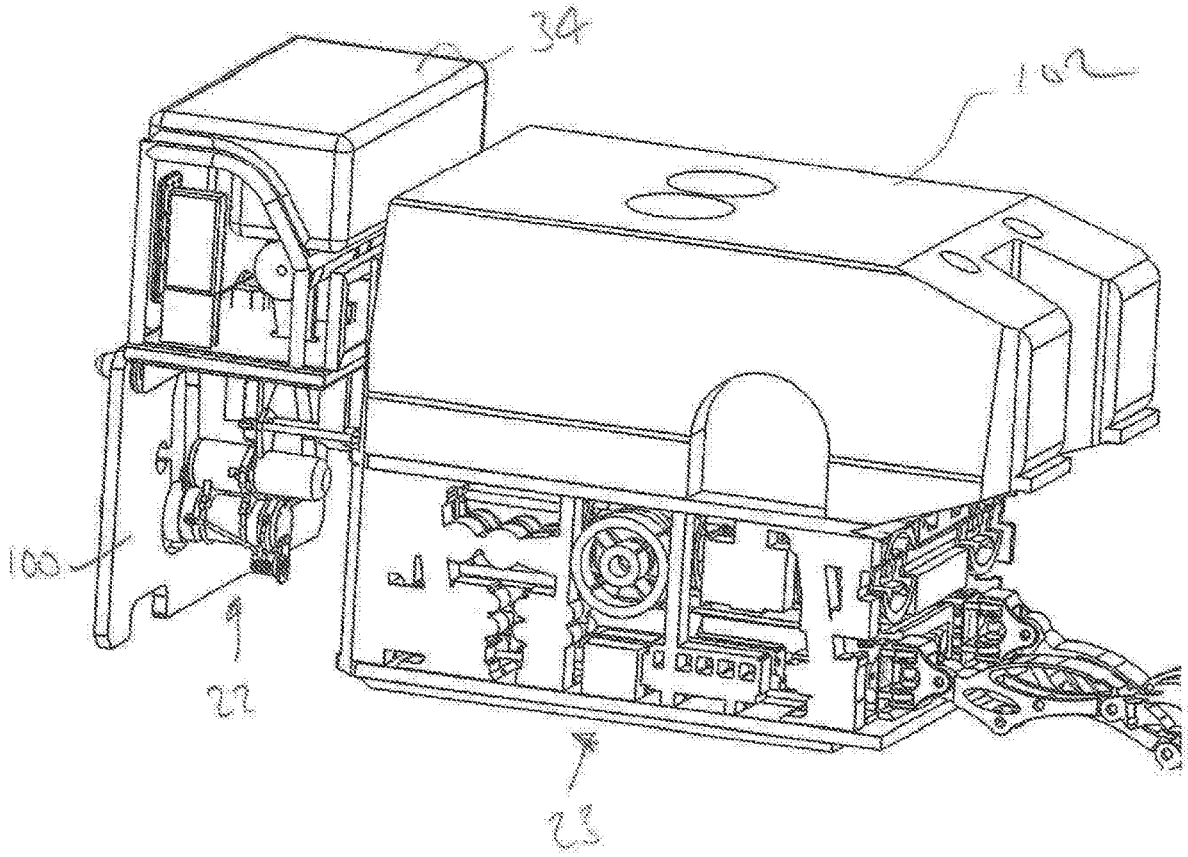
FIG. 3 is a perspective view of the tool of FIG. 1 being installed onto the subsea tree of FIG. 1 using an ROV.
Figure 4:
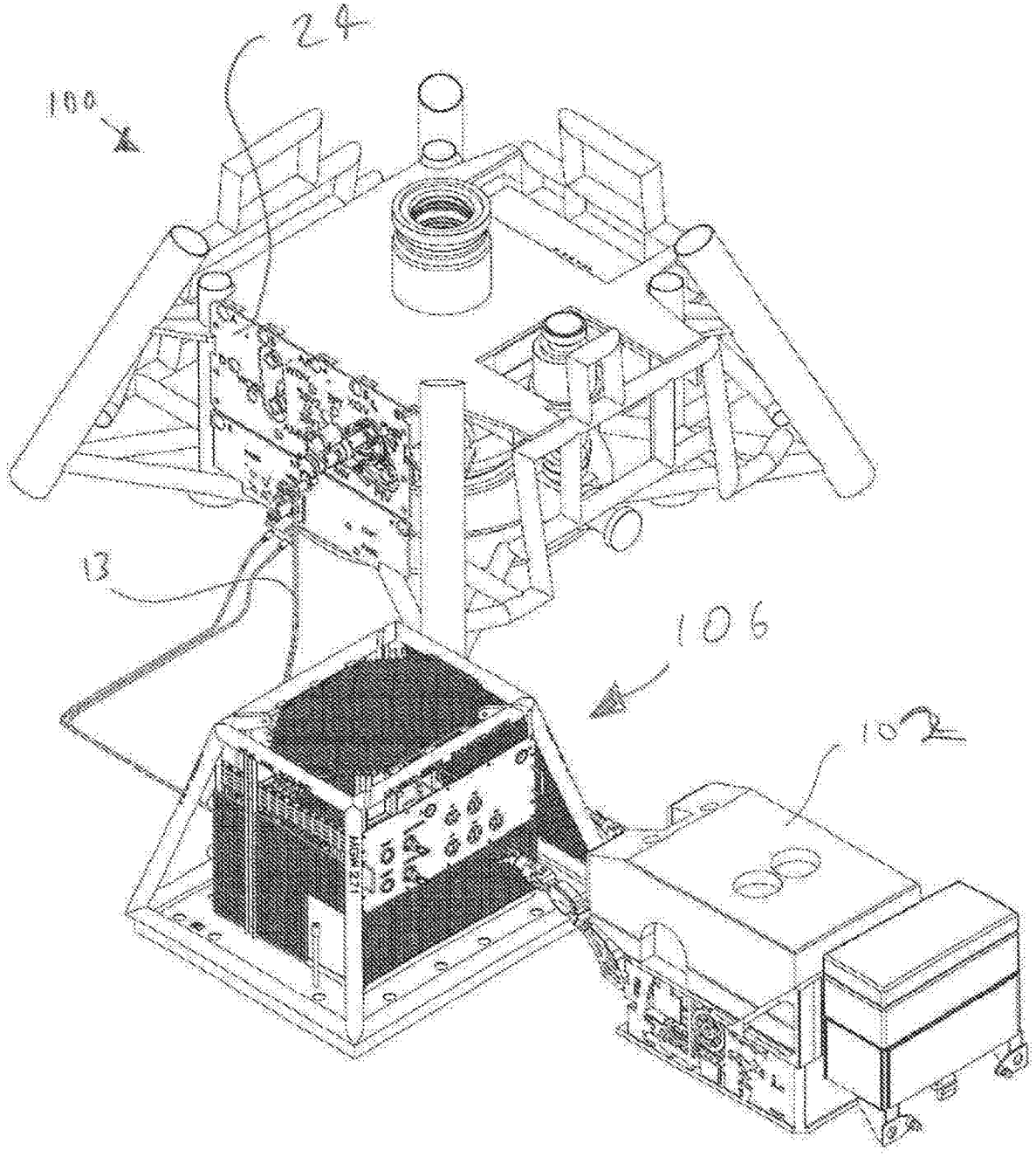
FIG. 4 is an isometric view of the subsea tree, the subsea control module (SCM), the tool of FIG. 1 and an ROV used for installation of the tool.

Referring to the drawings and initially to FIG. 1, an existing subsea tree 100 is depicted. The subsea tree 100 includes one or more valves (not shown). An actuator 10 is connected to and operates valve (not shown). Actuator 10 includes an actuator stem 12 and an actuator bayonet 11.

A standard subsea control module ("SCM") 106 is located near the subsea tree 100 and provides control power and hydraulic functions for the tree 100 in a known fashion.

In the present embodiment, actuator 10 is not operating within acceptable parameters and requires modification and intervention.

Tool 22 has been attached to the actuator 10. Tool 22 comprises a cylinder body 8, a cylinder cap 2 at an outboard end of the cylinder body 8, and a mating assembly 30 at an inboard end of the cylinder body 8. The skilled addressee will appreciate that use of "inboard end" and "outboard end" relate to the orientation of the tool 22 in relation to the tree 100 and actuator 10 and no further limitations are to be inferred from the use of such terminology.

Cylinder cap 2 comprises a generally cylindrical plug portion 2*a* with a flange portion 2*b* provided around its outboard end. Bolt holes 2*c* are provided on the flange portion 2*b*. Bolts 4 secure the cylinder cap 2 to the cylinder body 8 via bolt holes 2*c* and corresponding tapped bores 8*a* provided on the outboard end of the cylinder body 8.

A dished indentation 2*d* is provided on the face 2*e* of the plug portion 2*a* which is located within the cylinder body 8.

A piston 5 is disposed within cylinder body 8. Piston 5 comprises piston head 5*a* and piston stem 5*b*. Piston stem 5*b* protrudes out of the cylinder body 8. A cylinder wall 8*b* partially closes the cylinder body 8 at its inboard end. A piston stem guide Sc comprising a threaded aperture 8*d* extending through the cylinder end-wall 8*b* and a piston stem collar 8*e* is located on the cylinder end-wall 8*b*. Six O-ring piston stem seals 9 are provided within the bore of the piston stem guide 8*c*.

Piston Guide Rings 6 provides guidance for the piston 5. Similarly, seals 9 provide sealing and guidance to the piston 5 passing through the cylinder cap 2.

Mating assembly 30 comprises a locking collar 1 attached around a threaded portion 8*f* of the cylinder body 8 located proximal the inboard end. The threaded aperture 8*d* is slightly greater in diameter than the cylinder body 8. A socket portion 32 is created within threaded aperture 8*d* and around piston stem collar 8*c*.

Spring 21 is provided around piston stem collar 8*e* and within threaded portion 8*f* within socket portion 32.

Mating assembly 30 attaches to actuator bayonet 11 held together with locking collar 1. Piston stem 5*b* attaches to actuator stem 12. A thrust face 20, a generally flanged disk, abuts the inboard end of the piston stem collar 8*e* and the outboard end of the actuator bayonet 11. An O-ring seal bayonet seal 35 radially surrounds the thrust face 20. Spring 21 urges the bayonet seal 35 against the actuator bayonet 11.

In the present embodiment, a Remotely Operated Vehicle ("ROV") 102 deploys tool 22 onto tree 100. However, tool 22 may be diver deployed. ROV deployment allows for greater water depths to be achieved, where tree 100 may be located beyond a depth achievable by a diver.

A tool docking unit ("TDU") 34 is used to enable deployment by ROV 102. An API 17H standard TDU socket 16 is provided on the tool 22, to enable compatibility with widely used industry standards.

Torque tool square drive 17, drive shaft 18 and eccentric drive 19 are attached to the tool 22, and when the tool 22 is located on the tree 100, they are located on the upper surface of the tool 22.

The ROV 102 engages the TDU 34 into the TDU socket 16 on the tool 22 and carries the tool 22 in into position and engages it onto the actuator stem 12. The tool 22 is fitted with a unique locking drive, designed to lock the tool 22 on the actuator 10, part of the mating assembly 30.

The internal thrust face 20 of the tool 22, that engages with one side of the actuator stem is spring loaded to take up any residual clearance. The API 17H square drive 17, located inside the TDU socket 16 is attached to a rotating drive shaft 18, supported on bearings. The locking collar 1 on the tool 22 is connected to the drive shaft 18 via an eccentric lever arm 19. The locking function for the tool 22 is performed by the TDU torque tool engaged with the drive shaft 18 via the square drive 17.

The torque tool rotates the shaft 18 which in turn rotates the locking collar 1 on the tool 22, via the eccentric arm. This locks the tool 22 onto the actuator stem 12. The advantage of this method in that the ROV 102 performs the tool 22 deployment installation and locking, potentially all in one operation, withhold having the need to reposition, disconnect and reconnect.

The tool 22 is fitted with an ROV hot stab 3 to provide hydraulic supply to the cylinder and annulus sides. Alternatively the hydraulic connections can be made directly into the tool 22.

To facilitate installation of ancillary equipment and subsequent operation, the tool 22 is provided with an auxiliary skid 23. The purpose of the auxiliary skid 23 is to enable the tool 22 to be installed in the simplest matter to the subsea tree 100 existing SCM (subsea control module) 106.

The hydraulic fluid and pressure to power the tool 22 is routed from the existing subsea control module (SCM) 106 via an existing stab plate 24 located on the tree 100. All equipment necessary for effective operation of the tool 22 will be provided by the auxiliary skid 23 which will be deployed with the tool 22. To make connection with the tree stab plate 24, a bridging plate is provided from the auxiliary skid 23. The tool 22 is also connected hydraulically to the auxiliary skid 23. The auxiliary skid 23 contains all the necessary bladders, vales and hot stabs to enable direct control.

An auxiliary skid connects the override tool directly with the SCM (subsea control module) on the Christmas Tree 100. Using a modified bridging plate, the hydraulic supply pressure is routed from the SCM to the override tool via the auxiliary skid.

At the same time as routing the hydraulic power supply, the auxiliary skid 23 provides fluid compensation for the legacy actuator (original one on Christmas Tree 100), and an override system, using on board accumulators (not shown).

The auxiliary skid 23 has finality to control override tool 22 directly from the rig/intervention vessel in a workover scenario. This is done by a using an on board hot stab.

The piston 5 makes face to face contact with the actuator stem 12 and as such is able to provide the required thrust. To connect the hydraulic supply to the tool 22 the existing SCM supply line 13 to the actuator 10 is disconnected and reconnected to the tool 22. The supply cavity on the actuator 10 is rerouted to an actuator compensation bladder (not shown), to prevent seawater ingress into the actuator 10.

Once installed, the tool 22 reinstates functionality to the actuator 10 and therefore tree 100.

Since the SCM 106 provides power, hydraulic and control functionality to the tool 22, this may be considered a permanent modification and repair of the tree 100, and mitigates the requirement either to use the tree 100 without full functionality, or for complete replacement of the tree 100.

The invention is not limited to the embodiment hereinbefore described, but may be modified in both construction and detail.

The invention claimed is:

1. A subsea tool for permanently reinstating the functionality of a subsea tree valve actuator, by applying a thrust force to the subsea tree valve actuator stem, comprising a cylinder body which defines a fluid and pressure containing chamber, and a thrust rod for engaging with an actuator stem of the subsea tree valve actuator, wherein the tool gets its hydraulic supply to provide load on the actuator stem directly from a subsea tree SCM (subsea control module) hydraulic supply via an existing SCM hydraulic supply line to the subsea tree valve actuator stem, the subsea tool including a SCM supply line connector, wherein the hydraulic supply for the tool is shared with the existing SCM hydraulic supply line for the subsea tree valve actuator; and wherein the tool is adapted to be deployed by a remotely operated vehicle ("ROV") being provided with a tool docking unit socket to enable ROV-deployment.

2. The subsea tool of claim 1 wherein the tool is installed and left connected to the actuator for any length of time, up to the maximum design life of the tool.

3. The subsea tool of claim 1 wherein the tool is connectable to an actuator body surrounding said actuator stem.

4. The subsea tool of claim 1 further incorporating a bladder system connected to the annulus and/or the cylinder side of the tool.

5. A subsea tree comprising a plurality of tools according to claim 1.

6. A method of modifying a subsea valve component by permanently reinstating the functionality of a subsea tree valve actuator comprising the steps of:

deploying a tool from a remotely operated vehicle ("ROV"), the tool applying a thrust force to the subsea tree valve actuator stem, the tool comprising a cylinder body which defines a fluid and pressure containing chamber, and a thrust rod for engaging with an actuator stem of the subsea tree valve actuator, wherein the tool gets its hydraulic supply to provide load on the actuator stem directly from a subsea tree SCM (subsea control module) hydraulic supply via an existing SCM hydraulic supply line to the subsea tree valve actuator stem, the subsea tool including a SCM supply line connector, wherein the hydraulic supply for the tool is shared with the existing SCM hydraulic supply line for the subsea tree valve actuator, and using the subsea tree SCM (subsea control module) hydraulic supply to provide hydraulic power to the tool via an existing SCM supply line to the subsea tree valve actuator stem.

7. A subsea tree modified by the method of claim 6.

8. The method of claim 6 wherein the tool is installed and left connected to the actuator for any length of time, up to the maximum design life of the tool.

9. The method of claim 6 wherein the tool is connected to an actuator body surrounding said actuator stem.

10. The method of claim 6 wherein the tool is provided with a tool docking unit socket to enable said deployment from said ROV.

11. The method of claim 6 wherein the tool is connected to the actuator body.

12. An auxiliary skid suitable for use with a subsea tool for reinstating the functionality of a subsea tree valve actuator, the auxiliary skid being attachable to a Christmas tree or similar subsea valve arrangement, the auxiliary skid having an attachment to attach a subsea tool to it, the subsea tool comprising a cylinder body which defines a fluid and pressure containing chamber, and a thrust rod for engaging with an actuator stem of the subsea tree valve actuator, wherein the tool gets its hydraulic supply to provide load on the actuator stem directly from a subsea tree SCM (subsea control module) hydraulic supply via an existing SCM hydraulic supply line to the subsea tree valve actuator stem, the subsea tool including a SCM supply line connector, wherein the hydraulic supply for the tool is shared with the existing SCM hydraulic supply line for the subsea tree valve actuator, the auxiliary skid being able to be attached to a subsea control module, thereby allowing the subsea tool to be powered from the subsea control module.

13. The auxiliary skid of claim 12 further comprising a bridging plate.

14. The auxiliary skid of claim 13 wherein the bridging plate enables hydraulic supply pressure to be routed from a subsea control module to a subsea tool via the auxiliary skid.

15. The auxiliary skid of claim 12 further comprising one or more bladders to compensate for hydraulic volume and/or pressure.

16. The auxiliary skid of claim 12 further comprising one or more accumulators to compensate for hydraulic volume and/or pressure.

17. The auxiliary skid of claim 12 further comprising an on board hot stab.

* * * * *